US007821242B2

(12) United States Patent
Takagi

(10) Patent No.: US 7,821,242 B2
(45) Date of Patent: Oct. 26, 2010

(54) CONSTANT VOLTAGE CIRCUIT AND METHOD OF CONTROLLING OUPUT VOLTAGE OF CONSTANT VOLTAGE CIRCUIT

(75) Inventor: Yoshiki Takagi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 434 days.

(21) Appl. No.: 11/997,709

(22) PCT Filed: May 22, 2007

(86) PCT No.: PCT/JP2007/060762

§ 371 (c)(1),
(2), (4) Date: Feb. 1, 2008

(87) PCT Pub. No.: WO2007/145068

PCT Pub. Date: Dec. 21, 2007

(65) Prior Publication Data

US 2010/0156367 A1 Jun. 24, 2010

(30) Foreign Application Priority Data

Jun. 14, 2006 (JP) ..... 2006-164851

(51) Int. Cl.
*G05F 1/565* (2006.01)

(52) U.S. Cl. ..... 323/275; 323/280

(58) Field of Classification Search ..... 323/273–275, 323/280, 281, 312–316
See application file for complete search history.

(56) References Cited

U.S. PATENT DOCUMENTS

| | | | | |
|---|---|---|---|---|
| 5,864,227 | A | 1/1999 | Borden et al. | |
| 6,201,375 | B1 * | 3/2001 | Larson et al. | 323/277 |
| 7,212,043 | B2 * | 5/2007 | Gatta et al. | 327/77 |
| 7,221,213 | B2 * | 5/2007 | Lee et al. | 327/541 |
| 2003/0006743 | A1 | 1/2003 | Miyazaki | |

FOREIGN PATENT DOCUMENTS

| | | |
|---|---|---|
| JP | 10-254560 | 9/1998 |
| JP | 10-301642 | 11/1998 |
| JP | 2000-194431 | 7/2000 |
| JP | 2002-268758 | 9/2002 |
| JP | 2003-5848 | 1/2003 |

* cited by examiner

*Primary Examiner*—Jessica Han
(74) *Attorney, Agent, or Firm*—Cooper & Dunham LLP

(57) ABSTRACT

A constant voltage circuit for converting an input voltage input from an input terminal, converting the input voltage to a predetermined constant voltage, and outputting the converted voltage from an output terminal is disclosed that includes an output transistor for outputting a current corresponding to a control signal from the input terminal to the output terminal, a control circuit part for controlling operation of the output transistor so that a proportional voltage proportional to the voltage output from the output terminal is equal to a reference voltage, and a pseudo-load current control circuit part for supplying a pseudo-load current from the output terminal when detecting that the output transistor is switched off according to a voltage difference between the input voltage and a voltage of a gate of the output transistor.

14 Claims, 12 Drawing Sheets

CONSTANT VOLTAGE CIRCUIT AND METHOD OF CONTROLLING OUPUT VOLTAGE OF CONSTANT VOLTAGE CIRCUIT

TECHNICAL FIELD

The present invention relates to a constant voltage circuit and a method of controlling output voltage of the constant voltage circuit for reducing an increase of the output voltage caused by current leakage of an output transistor and improving input/output characteristics.

BACKGROUND ART

FIG. 11 shows a related art example of a constant voltage circuit using a series regulator. The constant voltage circuit shown in FIG. 11 includes a reference voltage generating circuit 101 for generating a predetermined reference voltage Vr and outputting the generated voltage Vr, an output transistor M101, an error amplifier circuit 102 including MOS transistors M102-M106, and resistors R101, R102 for detecting output voltage (hereinafter referred to as "output voltage detection resistors"). The error amplifier circuit 102 amplifies the voltage difference between the divided voltage Vfb divided by the output voltage resistors R101, R102 and the reference voltage Vr output by the reference voltage generating circuit 101, outputs the amplified voltage to a gate of the output transistor M101, and controls the output transistor M101 so that the output voltage Vo is stabilized at a predetermined voltage.

In recent years and continuing, it is desired to reduce the voltage difference (input/output voltage difference) between input voltage Vdd and the output voltage Vo as much as possible for reducing power consumption at the output transistor M101, to thereby reduce the power consumption of a device. It is also desired that the current flowing in the output voltage detection resistors R101, R102 be reduced as much as possible for reducing the consumption current inside the IC (Integrated Circuit). In order to reduce the difference between input voltage and output voltage, a transistor having a high driving capability is to be used for the output transistor M101. Furthermore, the threshold voltage of the output transistor M101 is reduced by shortening the length L of the gate of the output transistor M101 and increasing the width W of the gate of the output transistor M101.

In one exemplary related art case, there is a constant voltage circuit that can stabilize output voltage even where the current flow is low or null when operating with a low supply voltage (See for example Japanese Registered Patent No. 3643043). FIG. 12 is a circuit diagram showing such a constant voltage circuit. By adding a pseudo load circuit that supplies a predetermined current from the output transistor M111 in the circuit shown in FIG. 12, output voltage VOUT can be prevented from increasing even when no current flows in the load RL.

Here, however, a leakage current may occur in an off-state in a case of using a finely fabricated MOS transistor having a short gate length L or an MOS transistor having a small threshold voltage. Furthermore, a current leak of several μA may occur in a case of using a large MOS transistor having large gate width W and gate length L even where voltage Vgs between the gate and source. In a case where current flows to a connected load as in the circuit shown in FIG. 11, such leaking current has no effect on the output voltage since the leaking current can flow to the load. However, in a state where current flowing to the load ranges from 0 μA to several μA (i.e. almost no load), the leaking current, being unable to flow outside, flows to the output voltage detection resistors R101 and R102. Although it is possible to ignore the leaking current in a case where the leaking current is less than the current that steadily flows to the resistors R101 and R102, a large leaking current causes an increase of the output voltage Vo. Thus, the current flowing to the output voltage detection resistors R101, R102 cannot be reduced to an amount no greater than the leaking current of the output transistor M101, and reduction of power consumption cannot be accomplished.

FIG. 13 shows an example of temperature characteristics of a current i101 output from the output transistor M101 in a case where the constant voltage circuit shown in FIG. 11 is in a no load state. In the example shown in FIG. 13, the input voltage Vdd is 5V, the output voltage is 1V, and the current flowing to the output voltage detection resistors R101 and R102 is approximately 0.2 μA.

Although FIG. 13 shows a relatively steady current flowing in the range between low temperature and normal temperature, the above-described current leak occurs in the high temperature area.

FIG. 14 shows temperature characteristics of the output voltage Vo and the gate voltage of the output transistor M101 in a case where the constant voltage circuit of FIG. 11 is in a no load state.

As shown in FIG. 14, all the leaking current of the output transistor M101 flows into the output voltage detection resistors R101 and R102 since the current flowing to the load is 0 μA. Although the output transistor M101 attempts to regulate the current by switching to an off state (disconnected state), the gate voltage V101 of the output transistor M101 becomes substantially equal to the input voltage Vdd (5V) around 75° C. The output transistor M101 cannot control the output voltage Vo in a high temperature area of no less than 75° C. such that the output voltage Vo increases in proportion to the leaking current of the output transistor M101.

Although it is possible to increase the length L of the gate of the output transistor M101 or increase the threshold voltage of the transistor M101 for controlling the leaking current, such methods causes the difference between input voltage and output voltage to increase and result in large power consumption by the output transistor M101. Furthermore, with the configuration shown in FIG. 12, there is a problem where consumption current during a steady state increases due to the constantly operating pseudo load circuit 111.

DISCLOSURE OF INVENTION

It is a general object of the present invention to provide a constant voltage circuit and a method of controlling output voltage of the constant voltage circuit that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention can be realized and attained by a constant voltage circuit and a method of controlling output voltage of the constant voltage circuit particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a constant voltage circuit for converting an input voltage input from an input terminal, converting the input voltage to a predetermined constant voltage, and outputting the converted voltage from an output terminal, the constant voltage circuit including: an output transistor for outputting a current corresponding to a control signal from the input terminal to the output terminal; a control circuit part for controlling operation of the output transistor so that a proportional voltage proportional to the voltage output from the output terminal is equal to a reference voltage; and a pseudo-load current control circuit part for supplying a pseudo-load current from the output terminal when detecting that the output transistor is switched off according to a voltage difference between the input voltage and a voltage of a gate of the output transistor.

Furthermore, another embodiment of the present invention provides a method of controlling output voltage of a constant voltage circuit, the method including the steps of: a) controlling operation of an output transistor that outputs a current from an input terminal to an output terminal according to an input control signal so that a voltage proportional to a voltage output from the output terminal is equal to a predetermined reference voltage; b) converting a voltage input to the input terminal to a predetermined constant voltage; c) outputting the converted voltage from the output terminal; and d) supplying a pseudo-load current from the output terminal when detecting that the output transistor is switched off according to a voltage difference between the input voltage and a voltage of a gate of the output transistor.

BEST MODE FOR CARRYING OUT THE INVENTION

Figure 1:
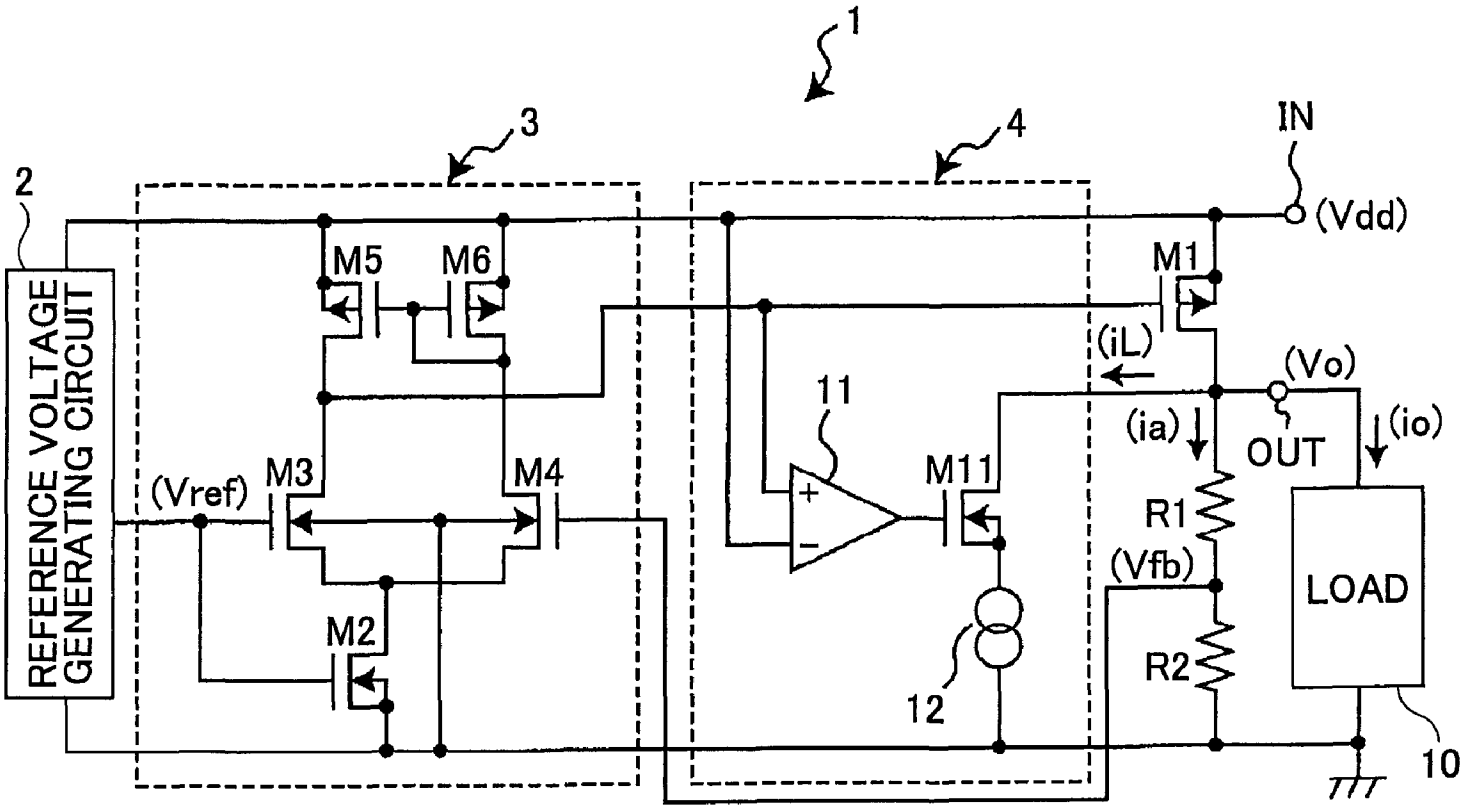
FIG. 1 is a circuit diagram showing an exemplary configuration of a constant voltage circuit according to a first embodiment of the present invention.

The present invention is described in detail based on the embodiments illustrated in the drawings.

First Embodiment

FIG. 1 is a circuit diagram showing an exemplary configuration of a constant voltage circuit 1 according to a first embodiment of the present invention. In FIG. 1, the constant voltage circuit 1 generates a predetermined constant voltage with an input voltage Vdd input from an input terminal IN. The constant voltage circuit 1 outputs the generated voltage as an output voltage Vo from an output terminal OUT to a load 10.

The constant voltage circuit 1 includes a reference voltage generating circuit 2 for generating a predetermined reference voltage Vref and outputting the generated voltage, an error amplifier circuit 3, an output transistor M1 including a PMOS transistor, output voltage detection resistors R1, R2, and a pseudo-load current controlling circuit 4 for supplying a pseudo-load current iL from the output terminal OUT to ground potential (ground voltage) when detecting that the output transistor M1 is switched to an off-state (disconnected state). The constant voltage circuit 1 may be integrated in a single IC.

The error amplifier circuit 3 includes NMOS transistors M2-M4 and PMOS transistors M5, M6. Furthermore, the pseudo-load current control circuit 4 includes a comparator 11, an NMOS transistor M11, and a constant current source 12. It is to be noted that, in this example, the reference voltage generating circuit 2, the error amplifier circuit 3, and the resistors R1 and R2 serve as a control circuit part; the pseudo-load current control circuit 4 serves as a pseudo-load current control circuit part; the comparator 11 serves as a voltage comparing circuit; and the NMOS transistor M11 serves as a switch.

The output transistor M1 is connected between the input terminal IN and the output terminal OUT. A substrate gate (also referred to as "back gate") of the output transistor M1 is connected to the source of the output transistor M1. The resistors R1 and R2 are connected in series between the output terminal OUT and ground. A divided voltage Vfb obtained by dividing the output voltage Vo is output from a joint part between the resistor R1 and the resistor R2.

In the error amplifier circuit 3, the NMOS transistor M3 and the NMOS transistor M4 serve as a differential pair and are connected to corresponding sources. The NMOS transistor M2 is connected between the joint part and ground. The NMOS transistor M2 serves as a constant current source in which reference voltage Vref is input to the gate of the NMOS transistor M2. Furthermore, the PMOS transistors M5 and M6 form a current mirror circuit. The PMOS transistors M5 and M6 serve as the loads of the NMOS transistors M3 and M4 serving as a differential pair. Each source of the PMOS transistors M5 and M6 is connected to the input voltage Vdd. The gate of the PMOS transistor M5 and the gate of the PMOS transistor M6 are connected and join at the drain of the PMOS transistor M6.

The drain of the PMOS transistor M5 is connected to the drain of the NMOS transistor M3, and the drain of the PMOS transistor M6 is connected to the drain of the NMOS transistor M4. The drain of the NMOS transistor M3 serving as an output terminal of the error amplifier circuit 3 is connected to the gate of the output transistor M1. The gate of the NMOS transistor M3 serves as a non-inverting input terminal allowing reference voltage Vref to be input thereto. The gate of the NMOS transistor M4 serves as an inverting input terminal of the error amplifier circuit 3 allowing divided voltage Vfb to be input thereto. Each substrate gate of the NMOS transistors M2-M4 is connected to ground. Each substrate gate of the PMOS transistors M5 and M6 is connected to the input voltage Vdd.

Next, in the pseudo-load current control circuit 4, the NMOS transistor M11 and the constant current source 12 are connected in series between the output terminal OUT and the ground. The gate of the NMOS transistor M11 is connected to the output terminal of the comparator 11. The non-inverting input terminal of the comparator 11 is connected to the gate of the output transistor M1. The input voltage Vdd is input to the inverting input terminal of the comparator 11.

With the above-configuration, the error amplifier circuit 3 controls operations of the output transistor M1 so that the divided voltage Vfb becomes substantially equal to the reference voltage Vref, and controls an output current io output from the output transistor M1 to the load 10. Since the output transistor M1 reduces power consumption by reducing the difference between input voltage and output voltage, the output transistor M1 is configured to have a short gate length L or a small threshold voltage. Such a configuration causes leaking current to flow in a case where temperature is high.

In the pseudo-load current control circuit 4, an offset is, for example, provided to at least one of the transistors serving as a differential pair, so that the comparator 11 has at least one of its input terminals provided with an offset. The comparator 11 outputs a high level signal from its output terminal when the voltage difference between the inverting input terminal and the non-inverting input terminal is no greater than a predetermined value. With consideration of the influence of factors such as varying of processes executed, the offset is set with a value enabling the comparator 11 to consistently operate in the manner described above.

The following describes a case where a current flowing to the load 10 (hereinafter also referred to as "current io") increases such that a current obtained by adding the current io and a current flowing to the serial circuit of resistors R1 and R2 (hereinafter also referred to as "current ia") becomes no less than the leaking current of the output transistor M1.

In this case, the error amplifier circuit 3 increases the gate/source voltage by reducing the gate voltage of the output transistor M1. Thus, the output terminal of the comparator 11 becomes a low level. Accordingly, the NMOS transistor M11 is turned to an off state (disconnected state), the pseudo-load current control circuit 4 stops operating, and the constant current source 12 serving as a pseudo-load between the output terminal OUT and ground becomes disconnected, thereby preventing pseudo-load current iL from flowing.

The following describes a case where the current io flowing to the load 10 decreases to 0-few μA such that a current obtained by adding the current io and the current is becomes less than the leaking current of the output transistor M1.

In this case, the leaking current works to increase the output voltage Vo by flowing into the output voltage detection resistors R1 and R2. However, the error amplifier circuit 3 operates to reduce the output voltage Vo by increasing the gate voltage of the output transistor M1 to a voltage substantially equal to the input voltage Vdd. Thus, the output terminal of the comparator M11 becomes a high level. Accordingly, the NMOS transistor M11 turns to an on state (conduction state) and the constant current source 12 serving as a pseudo-load between the output terminal OUT and the ground voltage becomes connected. As a result, the leaking current of the output transistor M1 flows to ground via the NMOS transistor M11 and the constant current source 12 instead of flowing to the output voltage detection resistors R1, R2. Thereby, the output voltage Vo can be prevented from being increased by the leaking current of the output transistor M1.

Figure 2:
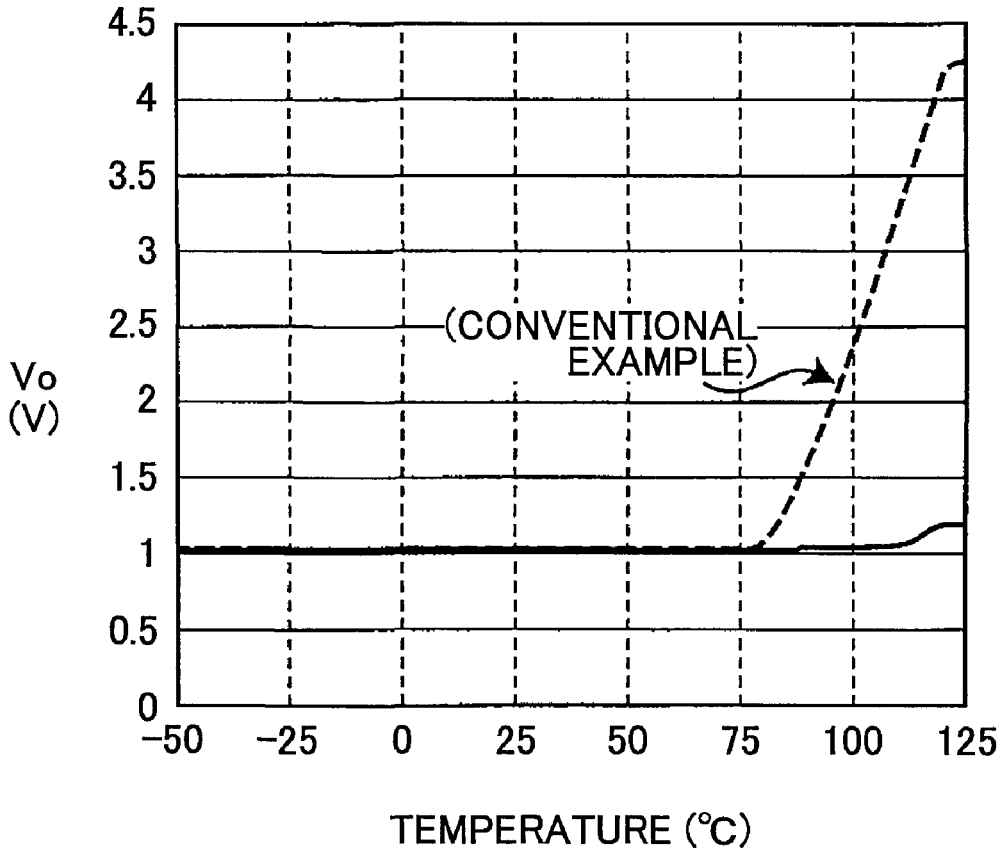
FIG. 2 is a graph for describing temperature characteristics of an output voltage Vo of the configuration shown in FIG. 1.

Hence, since the above-described constant voltage circuit according to a first embodiment of the present invention has a pseudo-load current control circuit 4 allowing a pseudo-load current iL to flow from the output terminal OUT to the ground voltage when the output transistor M1 is operated to an off state (disconnected state), increase of the output voltage Vo can be reduced considerably compared to a conventional example in a high temperature range of no less than 75° C. (see FIG. 2 showing temperature characteristics of the output voltage Vo of the constant voltage circuit 1 of FIG. 1 and the conventional example indicated with broken lines). Furthermore, increase of current consumption in a steady state can be reduced. Moreover, output voltage Vo can be prevented from being increased by the leaking current of the output transistor M1.

Figure 3:
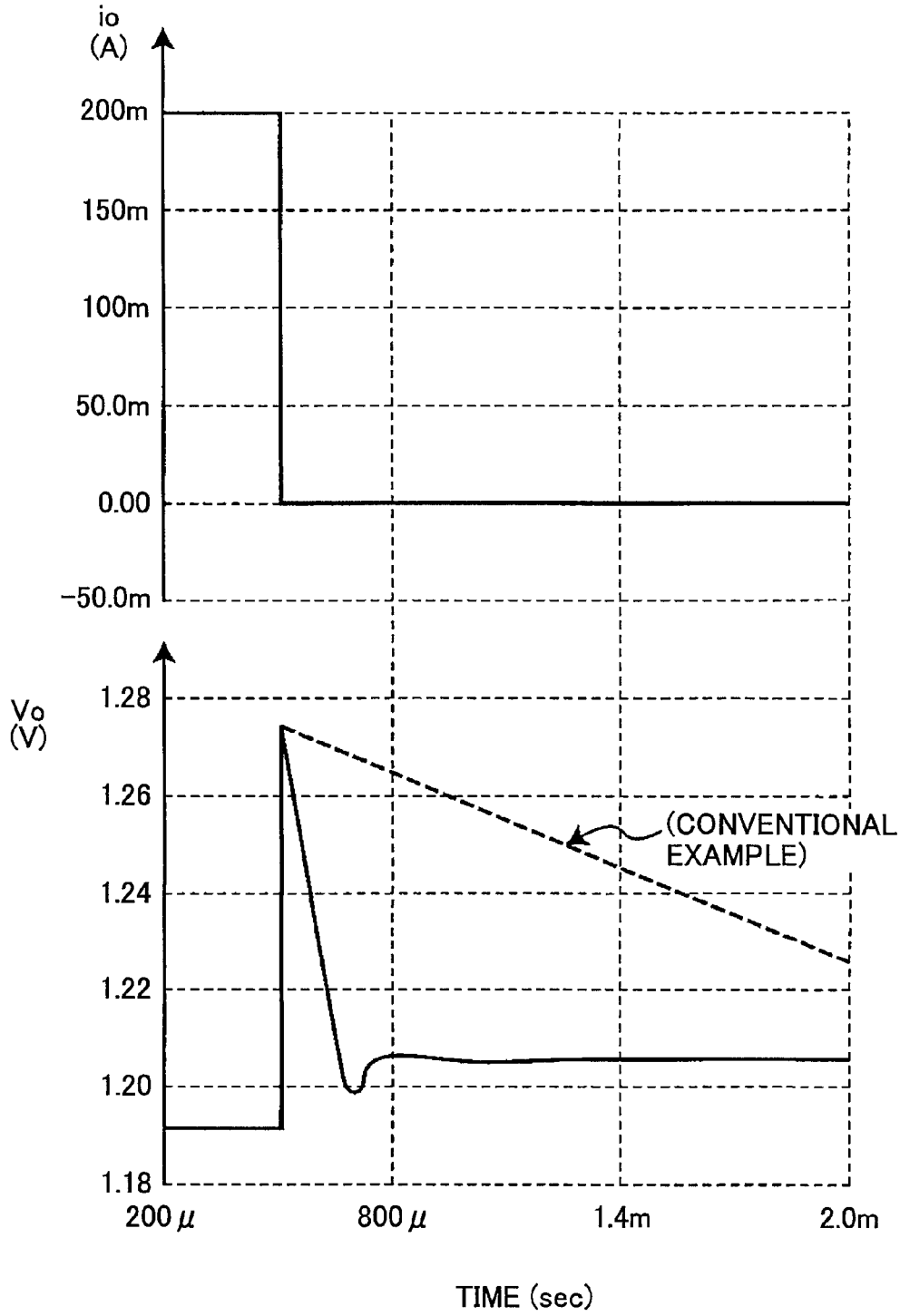
FIG. 3 is a graph for describing an example of a waveform of an output voltage of the configuration shown in FIG. 1 in a case of overshoot.
Figure 4:
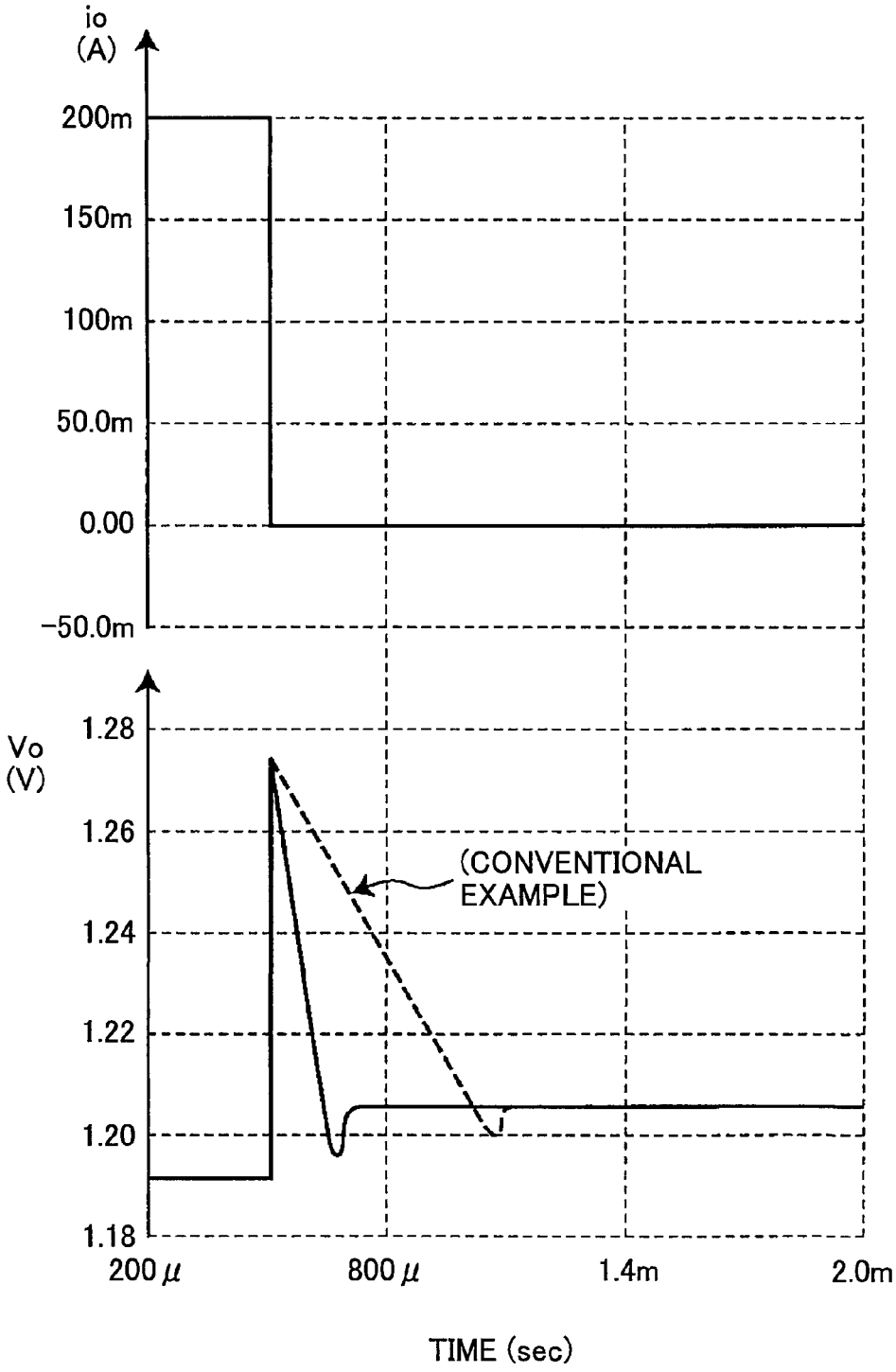
FIG. 4 is a graph for describing another example of a waveform of an output voltage of the configuration shown in FIG. 1 in a case of overshoot.

Furthermore, in a conventional case where the output voltage Vo overshoots (e.g., due to a load transient response when the load current io abruptly changes from a heavy load to a light load, an input transition upon a light load, or a transition upon turning on the electric power), a considerable amount of time is required for the output voltage Vo to become a steady constant voltage due to the fact that there are few passages allowing current to flow for reducing the increased output voltage Vo and that the amount of current flowing through such passages is small. Meanwhile, by using the pseudo-load current control circuit 4, the increased output voltage Vo can be lowered to a steady predetermined voltage in a shorter amount of time compared to a conventional example (indicated with broken lines) shown in FIGS. 3 and 4. It is to be noted that FIG. 3 illustrates a case where the load current io is reduced from 200 mA to 1 μA when the input voltage Vdd input to the constant voltage circuit 1 is 2.2 V and the constant voltage output from the constant voltage circuit 1 is 1.2 V. Furthermore, FIG. 4 illustrates a case where the load current io is reduced from 200 mA to 100 μA when the input voltage Vdd input to the constant voltage circuit 1 is 2.2 V and the constant voltage output from the constant voltage circuit 1 is 1.2 V.

Second Embodiment

Although the pseudo-load current control circuit 4 according to the first embodiment of the present invention uses a comparator, the pseudo-load current control circuit 4 may be configured as a circuit without a comparator but still capable of achieving reduction of current consumption. Such a configuration is used in the below-described constant voltage circuit 1*a* according to the second embodiment of the present invention.

Figure 5:
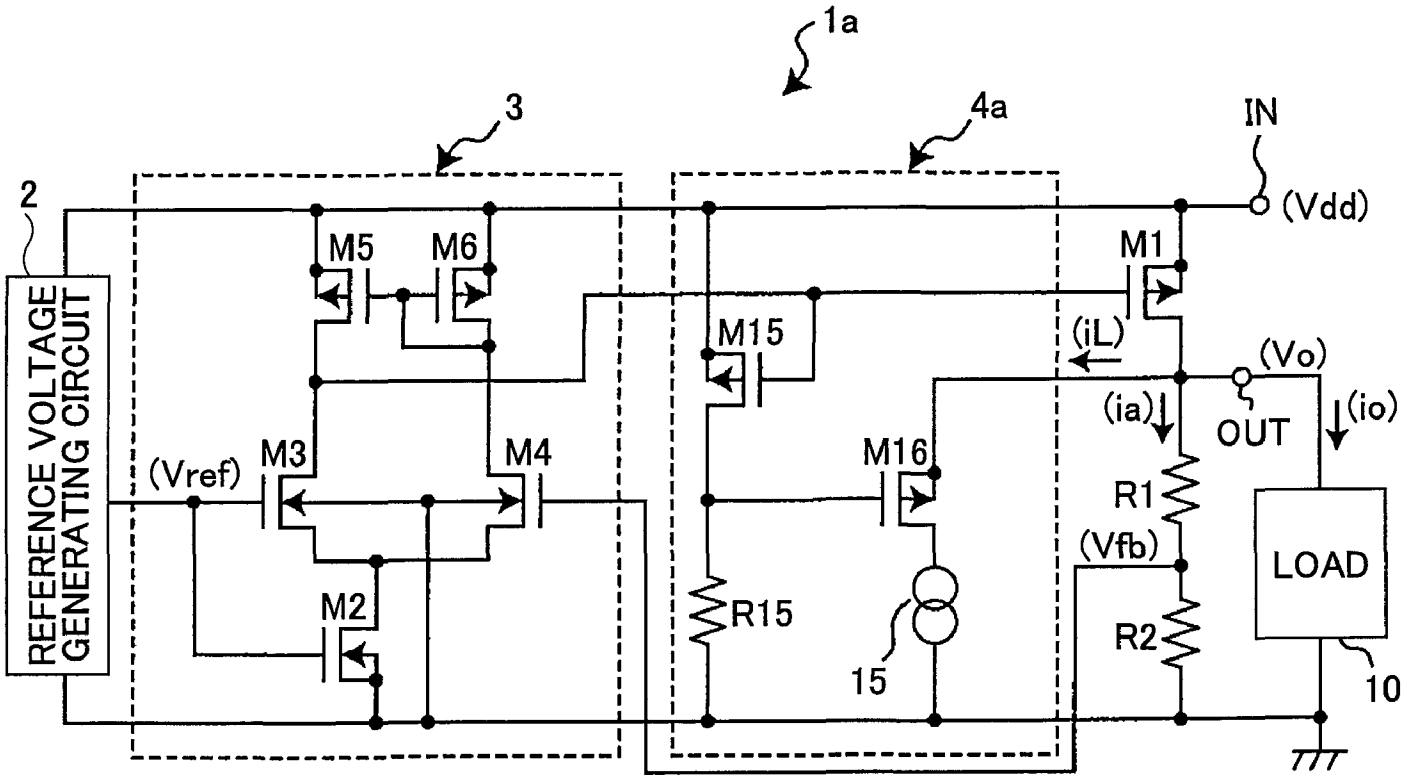
FIG. 5 is a circuit diagram showing an exemplary configuration of a constant voltage circuit according to a second embodiment of the present invention.

FIG. 5 is a circuit diagram showing an exemplary configuration of the constant voltage circuit 1*a* according to the second embodiment of the present invention. In FIG. 5, like components are described with like reference numerals as of FIG. 1 and further explanation thereof is omitted (i.e. differences compared to FIG. 1 are described below).

One of the differences compared to FIG. 1 is that reduction of current consumption is achieved by changing the inside circuit configuration of the pseudo-load current control circuit 4 of FIG. 1. Accordingly, the pseudo-load current control circuit of the second embodiment of the present invention is referred to as pseudo-load current control circuit 4*a* and the constant voltage circuit of the second embodiment of the present invention is referred to as constant voltage circuit 1*a*.

In FIG. 5, the constant voltage circuit 1*a* generates a predetermined constant voltage with an input voltage Vdd input from an input terminal IN. The constant voltage circuit 1*a* outputs the generated voltage as an output voltage Vo from an output terminal OUT to a load 10.

The constant voltage circuit 1*a* includes a reference voltage generating circuit 2, an error amplifier circuit 3, an output transistor M1, resistors R1, R2, and a pseudo-load current control circuit 4*a*. The pseudo-load current control circuit 4*a* is for supplying a pseudo-load current iL from the output terminal OUT to ground when the output transistor M1 is switched to an off-state (disconnected state). The constant voltage circuit 1*a* may be integrated in a single IC.

The pseudo-load current control circuit 4*a* includes PMOS transistors M15, M16, a resistor R15, and a constant current source 15. It is to be noted that, the pseudo-load current control circuit 4*a* serves as a pseudo-load current control circuit part, the PMOS transistor M15 serves as a proportional current generating circuit, the resistor R15 serves as a current-to-voltage converting circuit, and the PMOS transistor M16 serves as a switch.

In the pseudo-load current control circuit 4*a*, the PMOS transistor M15 and the resistor R15 are connected in series between the input voltage Vdd and the ground voltage, and the gate of the PMOS transistor M15 is connected to the gate of the output transistor M1. Furthermore, the PMOS transistor M16 and the constant current source 15 are connected in series between the output terminal OUT and ground, and the gate of the PMOS transistor M16 is connected to the joint part between the PMOS transistor M15 and the resistor R15.

In such configuration, the PMOS transistor M15 is the same device as the output transistor M1 but has a smaller size (transistor size) than the output transistor M1. In a case where the output transistor M1 is switched on, the PMOS transistor M15 outputs a current proportional to the current output from the output transistor M1. Then, the output proportional current is converted to a predetermined voltage by the resistor R15. Then, the converted voltage is input to the gate of the PMOS transistor M16. Thereby, the PMOS transistor M16 is switched to an off state (disconnected state).

Next, in a case where the output transistor M1 is switched off (disconnected state), the PMOS transistor M15 is also switched off (disconnected state). Accordingly, the gate voltage of the PMOS transistor M16 decreases. Then, the PMOS transistor M16 is switched on and connects to the constant current source 15 between the output terminal OUT and the ground voltage. Thereby, the constant current source 15 allows pseudo-load current iL to be supplied to ground. As a result, the leaking current of the output transistor M1 flows to ground via the constant current source 15 instead of flowing to the output voltage detection resistors R1, R2. Thereby, the output voltage Vo can be prevented from being increased by the leaking current of the output transistor M1.

Hence, since the above-described constant voltage circuit according to the second embodiment of the present invention does not use a large current consuming comparator but has a pseudo-load current control circuit 4*a* allowing a pseudo-load current iL to flow from the output terminal OUT to ground when the output transistor M1 is switched to an off state (disconnected state), not only can the same effects as the first embodiment be attained but also current consumption of the pseudo-load current control circuit 4*a* can be further reduced. Thus, reduction of current consumption can be achieved.

Third Embodiment

Since the size (transistor size) of the PMOS transistor M15 according to the second embodiment of present invention is small, the PMOS transistor M15 can only output a current of a few μA when switched on. Therefore, a voltage enough to switch off the PMOS transistor M16 is to be generated by using only the few μA current. This may require the resistance value of the resistor R15 to be considerably large. As a result, the condition of switching on the PMOS transistor M16 may be affected by varying of the resistance value of the resistor R15. The below-described constant voltage circuit according to the third embodiment of the present invention has a pseudo-load current control circuit capable of further reducing current consumption without being affected by the resistance value of the resistor 15.

Figure 6:
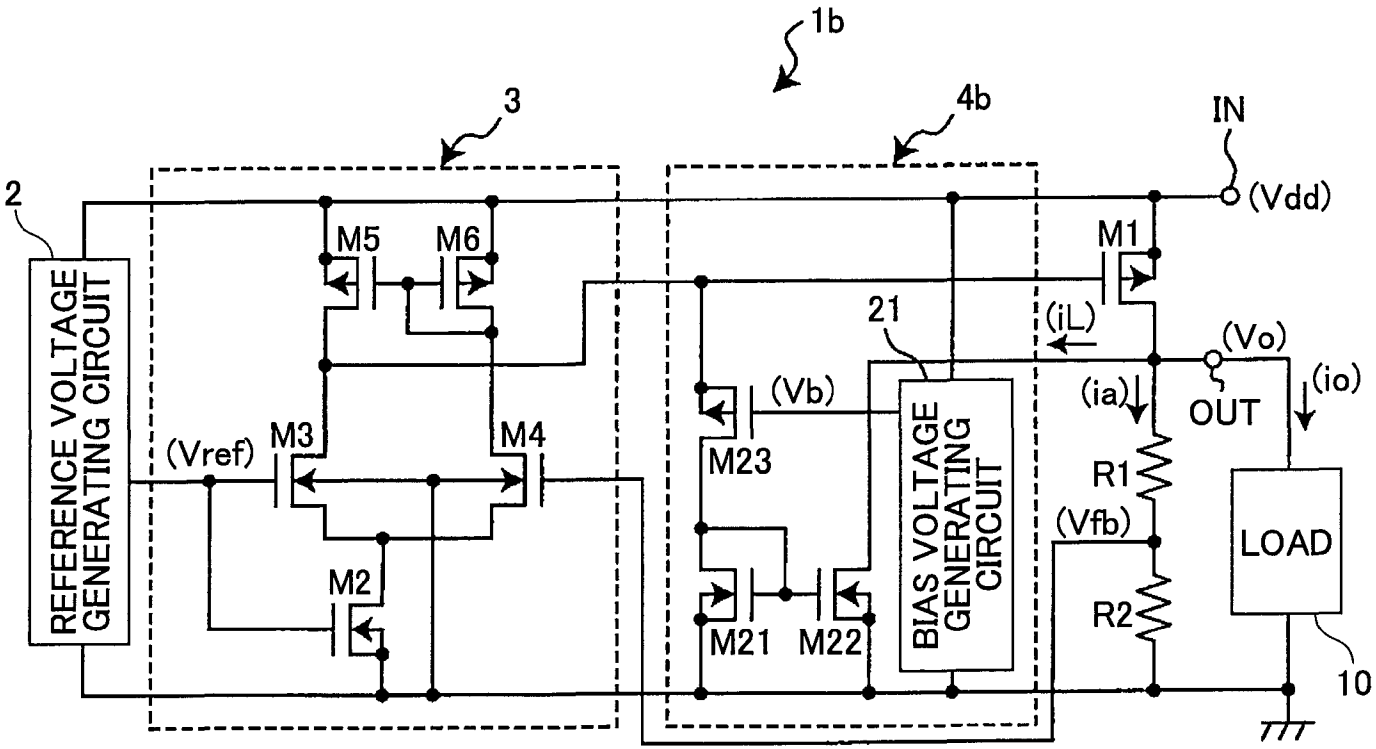
FIG. 6 is a circuit diagram showing an exemplary configuration of a constant voltage circuit according to a third embodiment of the present invention.

FIG. 6 is a circuit diagram showing an exemplary configuration of the constant voltage circuit 1*b* according to the third embodiment of the present invention. In FIG. 6, like components are described with like reference numerals as of FIG. 1 and further explanation thereof is omitted (i.e. differences compared to FIG. 1 are described below).

One of the differences compared to FIG. 1 is that reduction of current consumption is achieved by changing the inside circuit configuration of the pseudo-load current control circuit 4 of FIG. 1. Accordingly, the pseudo-load current control circuit of the third embodiment of the present invention is referred to as pseudo-load current control circuit 4*b* and the constant voltage circuit of the third embodiment of the present invention is referred to constant voltage circuit 1*b*.

In FIG. 6, the constant voltage circuit 1*b* generates a predetermined constant voltage with an input voltage Vdd input from an input terminal IN. The constant voltage circuit 1*b* outputs the generated voltage as an output voltage Vo from an output terminal OUT to a load 10.

The constant voltage circuit 1*b* includes a reference voltage generating circuit 2, an error amplifier circuit 3, an output transistor M1, resistors R1, R2, and a pseudo-load current control circuit 4*b*. The pseudo-load current control circuit 4*b* is for supplying a pseudo-load current iL from the output terminal OUT to ground when the output transistor M1 is switched to an off-state (disconnected state). The constant voltage circuit 1*b* may be integrated in a single IC.

The pseudo-load current control circuit 4*b* includes a bias voltage generating circuit 21. The bias voltage generating circuit 21 is for generating a bias voltage according to NMOS transistors M21, M22, a PMOS transistor M23, and an input voltage Vdd and outputting the generated bias voltage to the gate of the PMOS transistor M23. It is to be noted that, the pseudo-load current control circuit 4*b* serves as a pseudo-load current control circuit part, the bias voltage generating circuit 21 serves as a first voltage generating circuit, the PMOS transistor M23 serves as a first transistor, and the bias voltage Vb serves as a first voltage.

In the pseudo-load current control circuit 4*b*, the NMOS transistors M21 and M22 form a current mirror circuit. The source of each of the NMOS transistors M21, M22 is connected to ground. The gate of each of the NMOS transistors M21, M22 is connected to a drain of the NMOS transistor M21.

The drain of the NMOS transistor M21 is connected to a drain of the PMOS transistor M23. The drain of the NMOS transistor M22 is connected to the output terminal OUT. The source of the PMOS transistor M23 is connected to the gate of the output transistor M1. The bias voltage Vb is input to the gate of the PMOS transistor M23. Each substrate gate of the NMOS transistors M21, M22 is connected to ground. The substrate gate of the PMOS transistor M23 is connected to the source of the PMOS transistor M23.

In such configuration, the bias voltage generating circuit 21 of the pseudo-load current control circuit 4*b* generates a bias voltage Vb for switching on the PMOS transistor M23 when the gate voltage of the output transistor M1 becomes no less than a voltage for switching off the output transistor M1 (disconnected state). More specifically, the bias voltage generating circuit 21 generates a bias voltage Vb that is equal to or slightly less than a voltage obtained by subtracting a threshold voltage Vth of the PMOS transistor M23 from the input voltage Vdd, and outputs the generated bias voltage to the gate of the PMOS transistor M23.

The following describes a case where a current (load current) io flowing to the load 10 increases such that a current obtained by adding the current io and a current is flowing to the serially connected resistors R1, R2 becomes no less than the leaking current of the output transistor M1.

In this case, the error amplifier circuit 3 operates to reduce the gate voltage of the output transistor M1 and increase the voltage between the gate and the source. Thereby, the source voltage of the PMOS transistor M23 decreases and the voltage between the gate and the source (gate/source voltage) of the PMOS transistor M23 becomes smaller. Thus, the PMOS transistor M23 is switched off (disconnected state). In a case where the PMOS transistor M23 is switched off, both the NMOS transistors M21 and M22 become off (disconnected state). Accordingly, the pseudo-load current control circuit 4*b* stops operating, and the pseudo-load between the output terminal OUT and the ground voltage becomes disconnected.

The following describes a case where the current io flowing to the load 10 decreases to 0-few μA such that a current obtained by adding the current io and the current ao becomes less than the leaking current of the output transistor M1.

In this case, the leaking current works to increase the output voltage Vo by flowing into the output voltage detection resistors R1 and R2. However, the error amplifier circuit 3 operates to reduce the output voltage Vo by increasing the gate voltage of the output transistor M1 to a voltage substantially equal to the input voltage Vdd. In such case, the PMOS transistor M23 is switched on when the gate/source voltage becomes no less than a predetermined threshold voltage, thereby causing a current to flow in accordance with the size of the PMOS transistor M23 and the gate/source voltage. The NMOS transistor M21 and M22 mirrors the current and supplies current from the output terminal OUT to ground. As a result, the leaking current of the output transistor M1 flows to ground via the NMOS transistor M22 instead of to the output voltage detection resistors R1, R2. Thus, output voltage Vo can be prevented from being increased by the leaking current of the output transistor M1.

Figure 7:
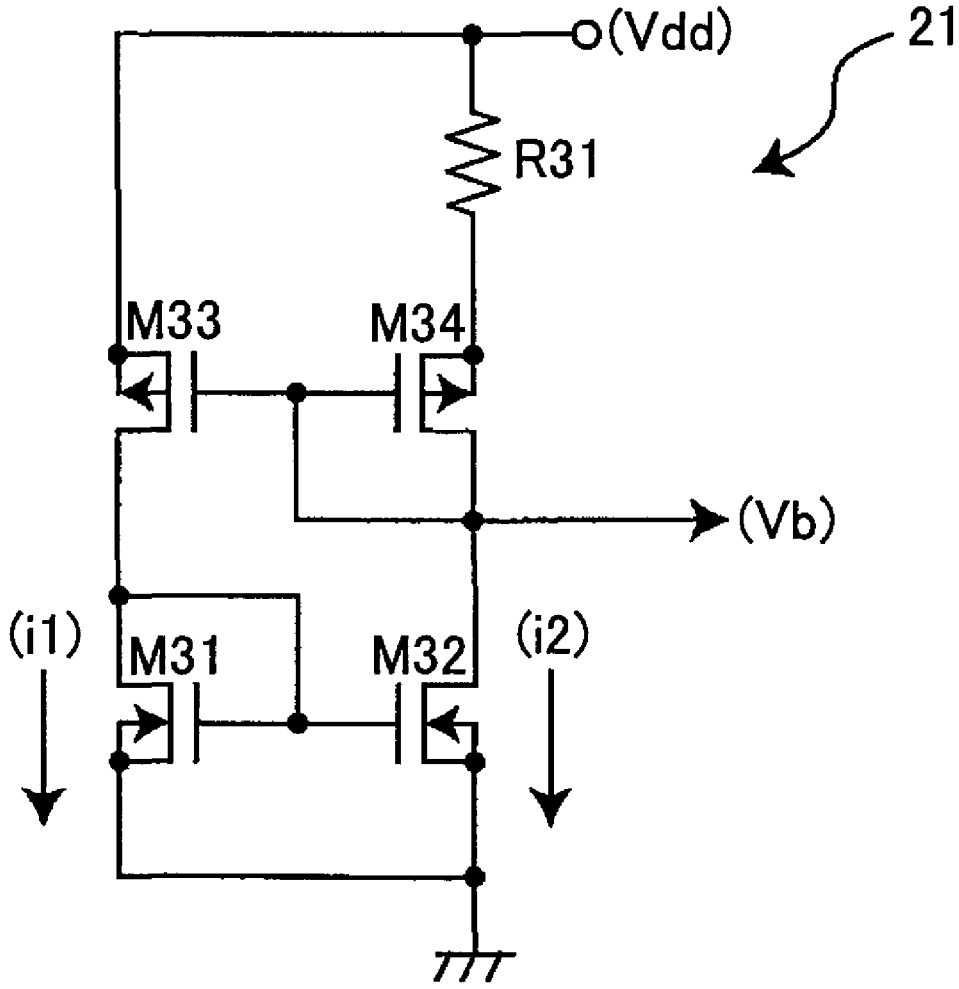
FIG. 7 is a circuit diagram showing an exemplary configuration of a bias voltage generating circuit shown in FIG. 6.

FIG. 7 is a circuit diagram showing an exemplary configuration of the bias voltage generating circuit 21 shown in FIG. 6.

In FIG. 7, the bias voltage generating circuit 21 includes NMOS transistors M31, M32, PMOS transistors M33, M34, and a resistor R31. The gate of the PMOS transistor M33 and the gate of the PMOS transistor M34 are connected, and the joint part of the connected gates of the PMOS transistors M33, M34 is connected to the drain of the PMOS transistor M34. The source of the PMOS transistor M33 is connected to the input voltage Vdd, and the source of the PMOS transistor M34 is connected to the input voltage Vdd via the resistor R31. Accordingly, the PMOS transistors M33, M34 form a current mirror.

The gate of the NMOS transistor M31 and the gate of the NMOS transistor M32 are connected, and the joint part of the connected gates of the NMOS transistors M31, M32 is connected to the drain of the NMOS transistor M31. The source of each NMOS transistors M31, M32 is connected to ground. Accordingly, the NMOS transistors M31, M32 form a current mirror. The drain of the NMOS transistor M31 is connected to the drain of the PMOS transistor M33, and the drain of the NMOS transistor M32 is connected to the drain of the PMOS transistor M34. The joint part between the PMOS transistor M34 and the NMOS transistor M32, which serves as an output terminal of the bias voltage generating circuit 21, is connected to the gate of the PMOS transistor M23.

The NMOS transistor M31 and the NMOS transistor M32 have substantially the same size (transistor size). The PMOS transistor M34 has a large transistor size, in which the PMOS transistor M34 is configured to have a greater gate width W or a shorter gate length L compared to the PMOS transistor M33. For example, by setting the transistor size ratio between the PMOS transistor M33 and the PMOS transistor M34 to 1:8, each MOS transistor M31-M34 operate in a saturation area.

The current i1 flowing to the NMOS transistor M31 and the current flowing to the NMOS transistor M32 is substantially equal. Accordingly, the relationship between the gate/source voltage Vgs33 of the PMOS transistor M33 and the gate/source voltage Vgs34 of the PMOS transistor M34 can be expressed with below-described Formula (1).

$$Vgs33 = Vgs34 + r31 \times i2 \quad (1)$$

It is to be noted that, "r31" in Formula (1) indicates the resistance value of the resistor R31.

Accordingly, the current i2, which can be expressed with below-described Formula (2), becomes a voltage that does not depend on the input voltage (source voltage) Vdd.

$$i2 = (Vgs33 - Vgs34)/r31 \quad (2)$$

Furthermore, since (Vgs33−Vgs34) has a predetermined temperature coefficient, a current i2 that does not depend on temperature can be obtained by using a resistor R31 having the same temperature coefficient as the predetermined temperature coefficient of (Vgs33−Vgs34). Here, the gate voltage of the PMOS transistor M33 is the bias voltage Vb, and the gate/source voltage Vgs of the PMOS transistor M33 is the voltage difference between the input voltage Vdd and the bias voltage Vb. Thus, the gate/source voltage Vgs of the PMOS transistor M33 is constantly a voltage required for enabling the PMOS transistor M23 to supply a predetermined flow. By using identical elements as the PMOS transistor M23 and the PMOS transistor M33, the PMOS transistor M23 can consistently supply a constant flow when the output transistor M1 becomes a disconnected state regardless of varying factors such as input voltage Vdd, temperature, or processing.

It is to be noted that the size and the gate/source voltage of the PMOS transistor M23 are not recommended to be too large since it shall exceed the current supplying capability of the PMOS transistor M5 and reduce current flowing from the PMOS transistor M23, thereby preventing desired effects from being sufficiently obtained. Accordingly, it is preferable that the PMOS transistor M23 to have a size capable of supplying only a small amount of current (e.g., approximately 0.1 μA) and adjust the size ratio between the NMOS transistors M21 and M22.

In FIG. 6, although the substrate gate of the PMOS transistor M23 is connected to the source, such connection allows the PMOS transistor M23 to be switched on when current is output by the output transistor M1 switched on according to varying factors (e.g., processing), to thereby cause the NMOS transistor M22 to supply pseudo-load current iL from the output terminal OUT to ground. In order to prevent this from occurring, the substrate gate of the PMOS transistor M23 may be connected to the input voltage Vdd as shown in FIG. 8.

Figure 8:
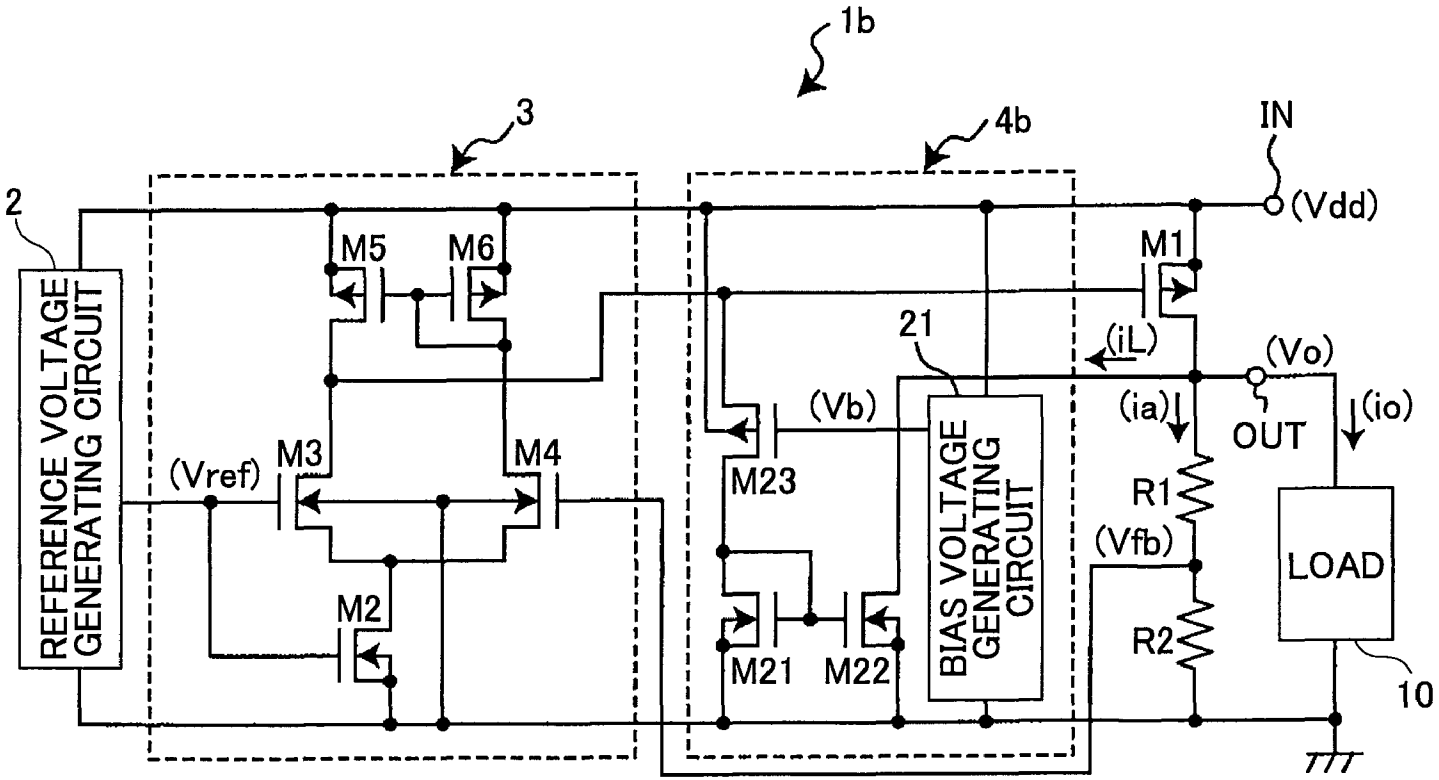
FIG. 8 is a circuit diagram showing another exemplary configuration of a constant voltage circuit according to a third embodiment of the present invention.

With the configuration shown in FIG. 8, a voltage which is greater than the source voltage is applied to the substrate gate of the PMOS transistor M23. This allows a substrate bias effect to increase the threshold voltage of the PMOS transistor M23. In a case where the load current io increases such that a current obtained by adding the load current io with a current is flowing in the serially connected resistors R1, R2 becomes no less than the leaking current of the output transistor M1, the source voltage of the PMOS transistor decreases. Furthermore, along with the gate/source voltage of the PMOS transistor M23 becoming smaller, the above-described substrate bias effect also occurs. Accordingly, since the PMOS transistor M23 cannot be switched on and the pseudo-load current control circuit 4*b* is not operational (not active), regulating (controlling) of operation and current consumption of the IC shall not be affected.

Figure 9:
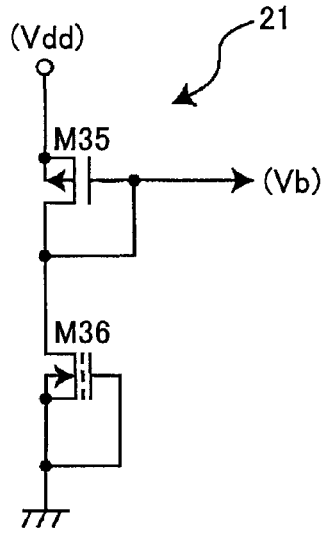
FIG. 9 is a circuit diagram showing another exemplary configuration of a bias voltage generating circuit shown in FIG. 6.
Figure 10:
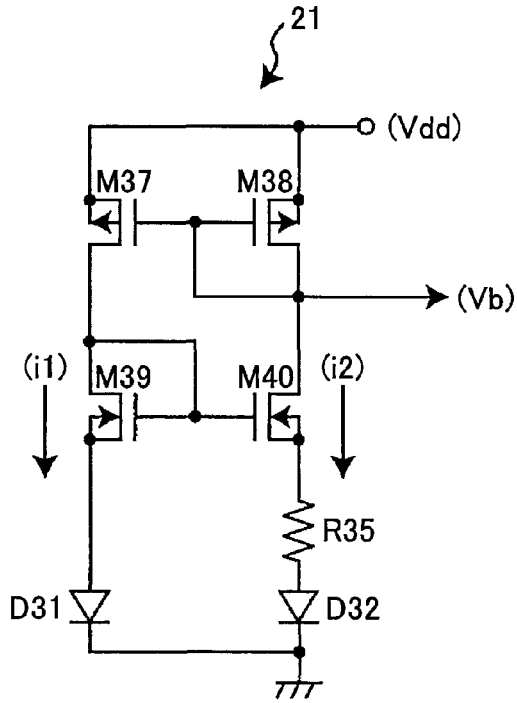
FIG. 10 is a circuit diagram showing yet another exemplary configuration of a bias voltage generating circuit shown in FIG. 6.
Figure 11:
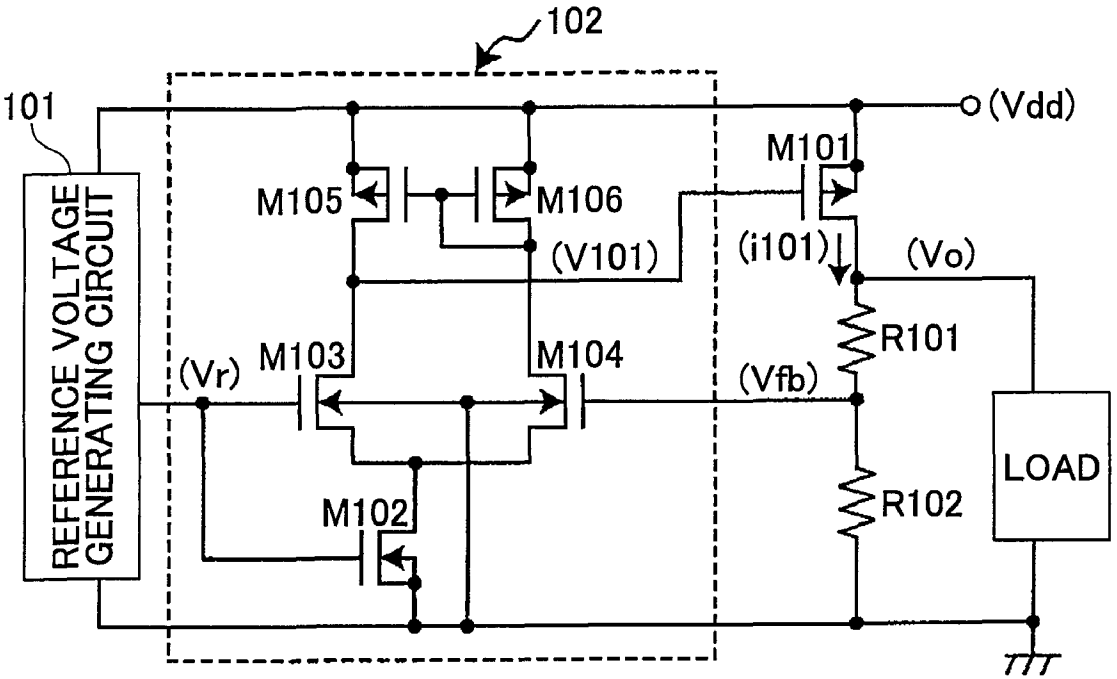
FIG. 11 is a circuit diagram showing a constant voltage circuit according to a related art example.
Figure 12:
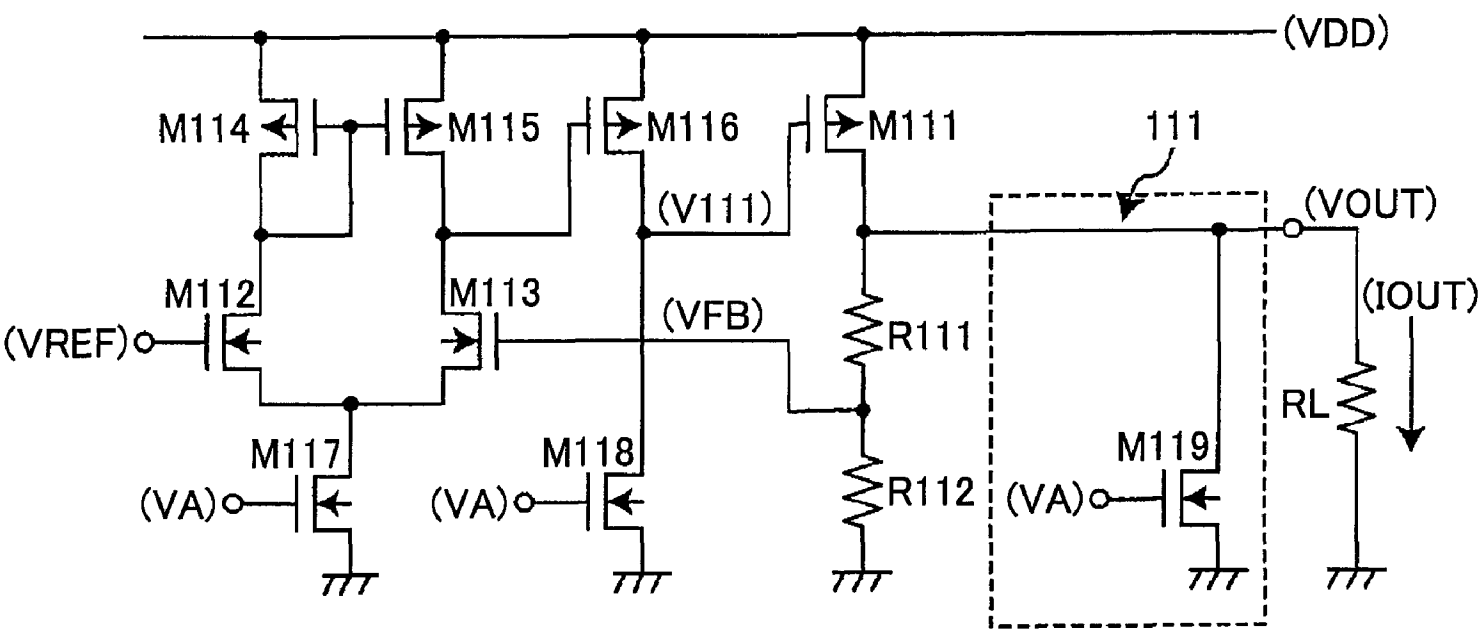
FIG. 12 is a circuit diagram showing a constant voltage circuit according to another related art example.
Figure 13:
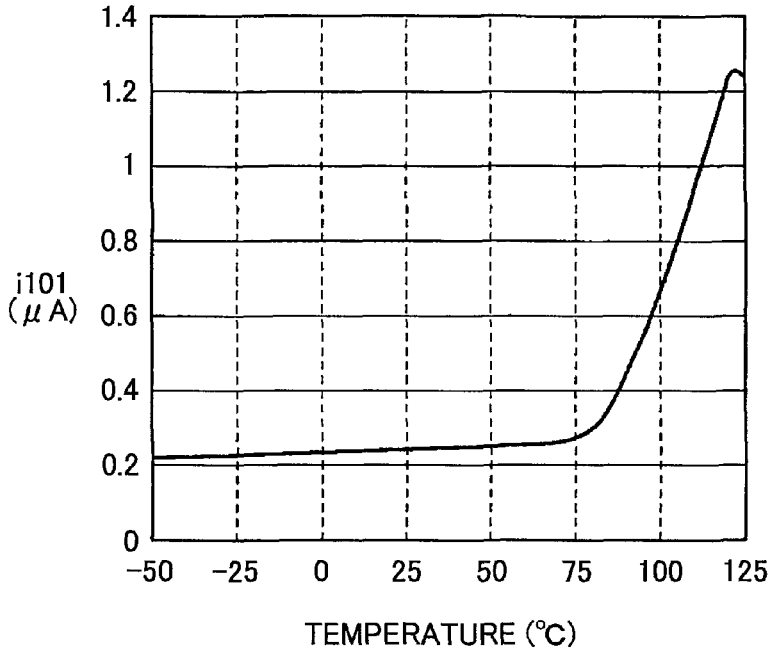
FIG. 13 is a graph for describing temperature characteristics of current flowing to an output transistor according to the configuration shown in FIG. 11 in a case where there is no load.
Figure 14:
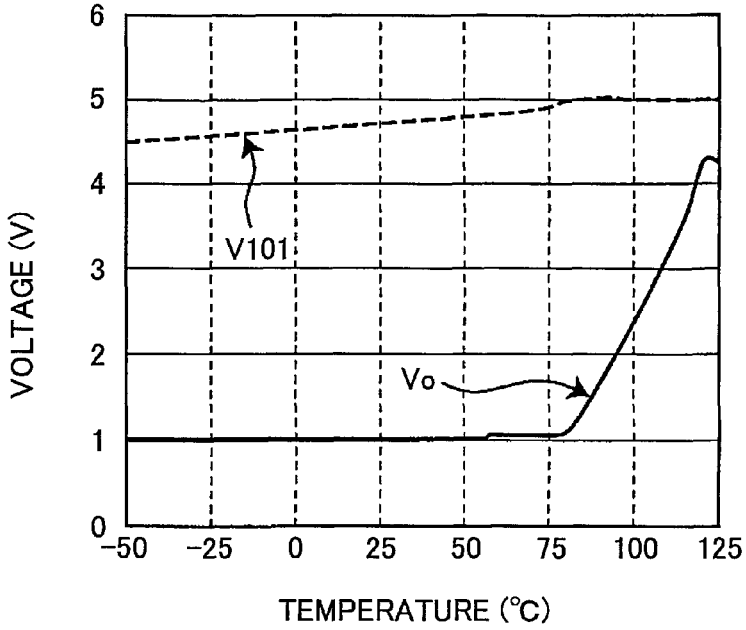
FIG. 14 is a graph for describing an output voltage and temperature characteristics of a gate voltage of an output transistor according to the configuration shown in FIG. 11.

FIGS. 9 and 10 are circuit diagrams showing other alternative exemplary configurations of the bias voltage generating circuit 21. Instead of the circuit shown in FIG. 7, the circuit shown in FIG. 9 or 10 may be used as the pseudo-load current control circuit 4*b*. In FIG. 9, a depletion type NMOS transistor M36 serving as a constant current source and a saturation-connected PMOS transistor M35 are connected, and the gate voltage of the PMOS transistor M35 is the bias voltage Vb.

In FIG. 10, a PMOS transistor M37 and a PMOS transistor M38 form a current mirror circuit in a band gap iref circuit, and the gate voltage of the PMOS transistors M37 and M38 is the bias voltage Vb.

Hence, since the above-described constant voltage circuit according to the third embodiment of the present invention has a pseudo-load current control circuit 4*b* allowing a pseudo-load current iL to flow from the output terminal OUT to the ground voltage when the output transistor M1 is switched to an off state (disconnected state), not only can the same effects as the second embodiment be attained but the pseudo-load current control circuit 4*b* can be operated more precisely.

Although a MOS transistor is used in the above-described first-third embodiments of the present invention, a junction type field effect transistor (JFET) may be used as an alternative for the MOS transistor, or a bi-polar transistor may be used as an alternative for the field effect transistor. However, in a case of using the bi-polar transistor, the current consumption is greater than a case of using a field effect transistor. Therefore, it may not preferable to use the bi-polar transistor in a case where reduction of current consumption is desired.

Further, the present invention is not limited to these embodiments, but variations and modifications may be made without departing from the scope of the present invention.

The present application is based on Japanese Priority Application No. 2006-164851 filed on Jun. 14, 2006 with the Japanese Patent Office, the entire contents of which are hereby incorporated by reference.

The invention claimed is:

1. A constant voltage circuit for converting an input voltage input from an input terminal, converting the input voltage to a predetermined constant voltage, and outputting the converted voltage from an output terminal, the constant voltage circuit comprising:

an output transistor for outputting a current corresponding to a control signal from the input terminal to the output terminal;

a control circuit part for controlling operation of the output transistor so that a proportional voltage proportional to the voltage output from the output terminal is equal to a reference voltage; and a pseudo-load current control circuit part for supplying a pseudo-load current from the output terminal when detecting that the output transistor is switched off according to a voltage difference between the input voltage and a voltage of a gate of the output transistor.

2. The constant voltage circuit as claimed in claim 1, wherein the pseudo-load current control circuit part includes a current source for connecting to the output terminal when detecting that the output transistor is switched off.

3. The constant voltage circuit as claimed in claim 2, wherein the pseudo-load current control circuit part further includes:

a voltage comparing circuit for comparing the input voltage and the voltage of the gate of the output transistor, and a switch for connecting the current source to the output terminal according to a control signal output from the voltage comparing circuit;

wherein the voltage comparing circuit instructs the switch to connect the current source to the output terminal when the voltage difference between the input voltage and the voltage of the gate of the output transistor is no greater than a predetermined value.

4. The constant voltage circuit as claimed in claim 3, wherein the voltage comparing circuit has an input terminal provided with an offset voltage.

5. The constant voltage circuit as claimed in claim 2, wherein the pseudo-load current control circuit part further includes:

a proportional current generating circuit for generating a current that is proportional to a current output from the output transistor and outputting the generated current, a current-to-voltage converting circuit for converting the generated current output by the proportional current generating circuit into voltage, and a switch for connecting the current source to the output terminal according to the voltage converted by the current-to-voltage converting circuit;

wherein the switch connects the current source to the output terminal when the current output from the proportional current generating circuit is no greater than a predetermined value.

6. The constant voltage circuit as claimed in claim 5, wherein the proportional current generating circuit includes a transistor having a gate for receiving current from the gate of the output transistor, wherein the transistor is a same type as the output transistor.

7. The constant voltage circuit as claimed in claim 2, wherein the pseudo-load current control circuit part further includes:

a first voltage generating circuit for generating a first voltage that is a predetermined amount lower than the input voltage and outputting the generated first voltage, a first transistor having an input end connected to the gate of the output transistor and a gate for receiving the first voltage from the first voltage generating circuit, the first transistor outputting a current from an output end according to a voltage difference between a voltage of the input terminal and the first voltage, and a current mirror circuit supplying a current proportional to the current output from the first transistor;

wherein the first transistor outputs the current according to the voltage difference when the voltage difference is no less than a predetermined value.

8. The constant voltage circuit as claimed in claim 7, wherein the first voltage generated and output by the first voltage generating circuit is no less than a voltage obtained by subtracting a threshold voltage of the first transistor from the input voltage.

9. The constant voltage circuit as claimed in claim 8, wherein the first transistor includes a P channel type MOS transistor having a source connected to the gate of the output transistor, a gate for receiving the first voltage, and a drain connected to an input end of the current mirror circuit.

10. The constant voltage circuit as claim in claim 9, wherein the first transistor further includes a substrate gate connected to the source.

11. The constant voltage circuit as claimed in claim 9, wherein the first transistor further includes a substrate gate connected to the input voltage.

12. The constant voltage circuit as claimed in claim 1, wherein the output transistor, the control circuit part, and the pseudo-load current control circuit part are integrated on a single IC.

13. A method of controlling output voltage of a constant voltage circuit, the method comprising the steps of:

a) controlling operation of an output transistor that outputs a current from an input terminal to an output terminal according to an input control signal so that a voltage proportional to a voltage output from the output terminal is equal to a predetermined reference voltage;

b) converting a voltage input to the input terminal to a predetermined constant voltage;

c) outputting the converted voltage from the output terminal; and d) supplying a pseudo-load current from the output terminal when detecting that the output transistor is switched off according to a voltage difference between the input voltage and a voltage of a gate of the output transistor.

14. The method of controlling output voltage of a constant voltage circuit as claimed in claim 13, wherein step d) includes a step of connecting the output terminal to a current source when detecting that the output transistor is switched off.

* * * * *